US007200893B2

(12) United States Patent
Gerber et al.

(10) Patent No.: US 7,200,893 B2
(45) Date of Patent: Apr. 10, 2007

(54) BRUSH ASSEMBLY FOR A FLOOR CLEANING UNIT

(75) Inventors: Douglas E. Gerber, North Canton, OH (US); Kenneth H. Cooper, Akron, OH (US); Arne J. Diehl, North Canton, OH (US); Sergey V. Makarov, Solon, OH (US); Mark A. Stranksy, Munroe Falls, OH (US); William H. Theiss, Jr., Canton, OH (US)

(73) Assignee: The Hoover Company, North Canton, OH (US)

( * ) Notice: Subject to any disclaimer, the term of this patent is extended or adjusted under 35 U.S.C. 154(b) by 437 days.

(21) Appl. No.: 10/340,291

(22) Filed: Jan. 10, 2003

(65) Prior Publication Data

US 2004/0134015 A1 Jul. 15, 2004

(51) Int. Cl.
*A47L 7/00* (2006.01)
*A47L 9/06* (2006.01)

(52) U.S. Cl. ..... 15/398; 15/400; 15/414; 15/322

(58) Field of Classification Search ..... 15/320, 15/322, 371, 393, 398, 400, 414
See application file for complete search history.

(56) References Cited

U.S. PATENT DOCUMENTS

| | | | | |
|---|---|---|---|---|
| 1,221,324 | A | 4/1917 | Hodshar | |
| 3,860,989 | A | 1/1975 | Johnston | 15/49 |
| 3,959,848 | A | 6/1976 | Rother | 15/372 |
| 4,662,024 | A | 5/1987 | Moench | 15/230.19 |
| 4,673,307 | A | 6/1987 | Prestele | 401/289 |
| 5,243,727 | A | 9/1993 | Tanka et al. | 15/98 |
| 5,485,652 | A | 1/1996 | Holland | 15/322 |
| 5,500,977 | A | 3/1996 | McAllise et al. | 15/320 |
| 5,857,619 | A | 1/1999 | Huang et al. | 239/11 |
| 6,009,593 | A * | 1/2000 | Crouser et al. | 15/320 |
| 6,467,122 | B2 | 10/2002 | Lenkiewicz | 15/320 |
| 6,647,578 | B2 * | 11/2003 | Morgan et al. | 15/320 |
| 6,832,409 | B2 * | 12/2004 | Morgan et al. | 15/320 |
| 6,842,942 | B2 * | 1/2005 | Morgan et al. | 15/322 |
| 2003/0051306 | A1 * | 3/2003 | Morgan et al. | 15/320 |

FOREIGN PATENT DOCUMENTS

| | | |
|---|---|---|
| CA | 525802 | 6/1956 |
| CH | 686656 | 5/1996 |
| EP | 0 434 907 A3 | 7/1991 |
| JP | 1232918 | 9/1989 |
| JP | 11313787 A2 | 11/1999 |
| JP | 2002238815 | 8/2002 |

OTHER PUBLICATIONS

Owner's Manual of The Hoover Company's STEAMVAC Supreme of Aug. 1997 with copyright notice dated 1993, 1996 and 1997.

* cited by examiner

*Primary Examiner*—Theresa T. Snider
(74) *Attorney, Agent, or Firm*—Renner, Kenner, Greive, Bobak, Taylor & Weber

(57) ABSTRACT

A floor cleaning device having a base assembly for movement along a cleaning surface is provided. The base assembly comprises a brush assembly for engaging the surface of the floor being cleaned removably mounted to a base part. A nozzle assembly is removably mounted to the base part such that the nozzle assembly is positioned adjacent to the brush assembly to prevent the brush assembly from disengaging from the base part.

15 Claims, 8 Drawing Sheets

BRUSH ASSEMBLY FOR A FLOOR CLEANING UNIT

BACKGROUND OF THE INVENTION

1. Field of the Invention

The present invention relates to floor cleaning unit having a brush assembly.

2. Background Information

It is known in the prior art to provide a floor cleaning unit having brushes to assist in scrubbing of the surface being cleaned. The brush assembly is generally affixed to the main body of the floor cleaning unit. However, after many times of use, a user may want to remove the brush assembly to clean the brushes or replace them due to the wear and tear of their bristles.

One example of a brush removal device is illustrated by commonly owned U.S. Pat. No. 6,009,593 issued to Crouser. This patent generally comprises an elongate brush support beam having integrally molded, spaced apart, vertically aligned cylindrical bearings each receiving therein a vertically directed axle shaft of an associated rotary scrubbing brush. The brush assembly has outwardly projecting resilient tangs 51 depending from the lower end of gear guard 32A. Each tab snaps into vertically elongated grooves or slots 53 and 57 respectively of lower housing in the base module 10 of the carpet extractor. Each tab has hook portions at its free end that will engage the bottom end of the vertical slot to support the guard and brush support beam. The resilient tabs are pressed inwardly by a user to disengage the hooks from the bottom end of the vertical slot and thus, allow removal of the brush block. However, due to the structure and arrangement of the tangs with respect to the brush block, a user has some difficulty in accessing, grasping, and pressing the tabs inwardly. Often, a tool such as a screwdriver has to be used by the user to press the tabs inwardly.

Hence, it is an object of the present invention to provide a brush assembly that is easily removed from a floor cleaning unit by a user.

It is another object of the present invention to provide a brush assembly of a floor cleaning unit with improved distribution of cleaning solution.

SUMMARY OF THE INVENTION

The foregoing and other objects of the present invention will be readily apparent from the following description and the attached drawings. In one embodiment of the present invention, an improved floor cleaning unit having a base assembly for movement along a cleaning surface is provided. The base assembly comprises a brush assembly for engaging the surface of the floor being cleaned mounted to a base part. A nozzle assembly is removably mounted to the base part such that the nozzle assembly is positioned adjacent to the brush assembly to prevent the brush assembly from disengaging from the base part.

In another aspect of the invention, an improved floor cleaning unit having a base assembly for movement along a cleaning surface is provided. The base assembly comprises a nozzle assembly and a brush assembly for engaging the surface of the floor being cleaned mounted to a base part. The brush assembly includes a support member having a plurality of rows of bristles extending downwardly. A dispensing bar is provided to the support member and includes a row of fluid distribution openings parallel to the rows of bristles. The row of fluid distribution openings is positioned between two rows of bristles.

In still another aspect of the invention, a method for removing a brush assembly from a floor cleaning unit having a nozzle assembly is disclosed. The method includes the steps of removing the nozzle assembly to allow access to the brush assembly and then removing the brush assembly from the brush assembly from the floor cleaning device.

BRIEF DESCRIPTION OF THE DRAWINGS

The invention will now be described, by way of example, with reference to the attached drawings, of which.

DETAILED DESCRIPTION OF THE INVENTION

Figure 1:
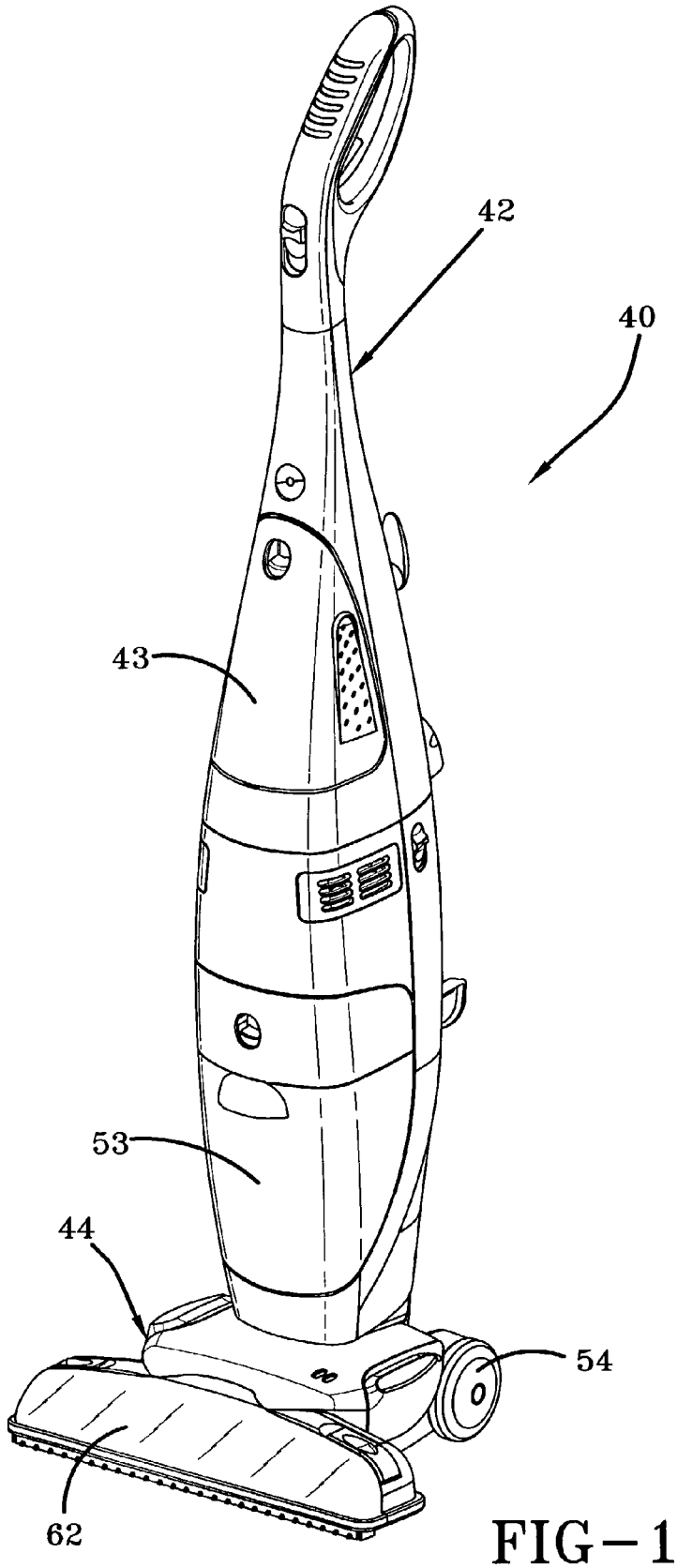
FIG. 1 is a perspective view of the floor cleaning unit of one embodiment according to the present invention.

Referring to the drawings, FIG. 1 depicts a perspective view of an upright hard floor-cleaning unit 40 of one embodiment of the present invention. The hard floor cleaning unit 40 comprises an upright handle assembly 42 pivotally connected to the rear portion of a base assembly 44 that moves and cleans along a surface. The base assembly 44 includes a nozzle assembly 62 for recovering particles and/or fluid from the floor and a brush block assembly 216 (FIGS. 2, 4–8) for scrubbing the floor. The base assembly 44 further includes a frame 52 (FIG. 2) which is generally unitary molded and includes two laterally displaced rear wheels 54. The handle assembly 42 includes a recovery tank 53 for collecting the particles and/or fluid picked up by the nozzle assembly 62 and a solution tank 43 containing cleaning solution for distribution on the floor.

Generally, the hard floor cleaning unit 40 can be used for two modes of cleaning, the dry and wet mode as best illustrated in FIG. 18 in U.S. Pat. No. 6,297,409; the disclosure of which is incorporated by reference. In the dry mode, the nozzle assembly 62 and brush block assembly 216 are raised to allow pick up of large loose particles. In the wet mode the nozzle assembly 62 is lowered to collect the fluid and pick it up. Also, in the wet mode, the brush block assembly 216 can be lowered by a lifting lever 718 (FIG. 2), if desired, to scrub the floor. Both the nozzle assembly 62 and brush block assembly 216 are removable from the base assembly 44. As best shown in FIG. 3, a hood or cover 172 snap fits onto the frame 52 and includes dry mode and wet mode openings or windows 174 and 176, respectively, to inform the user that the hard floor cleaner is in either the dry mode or wet mode.

Figure 2:
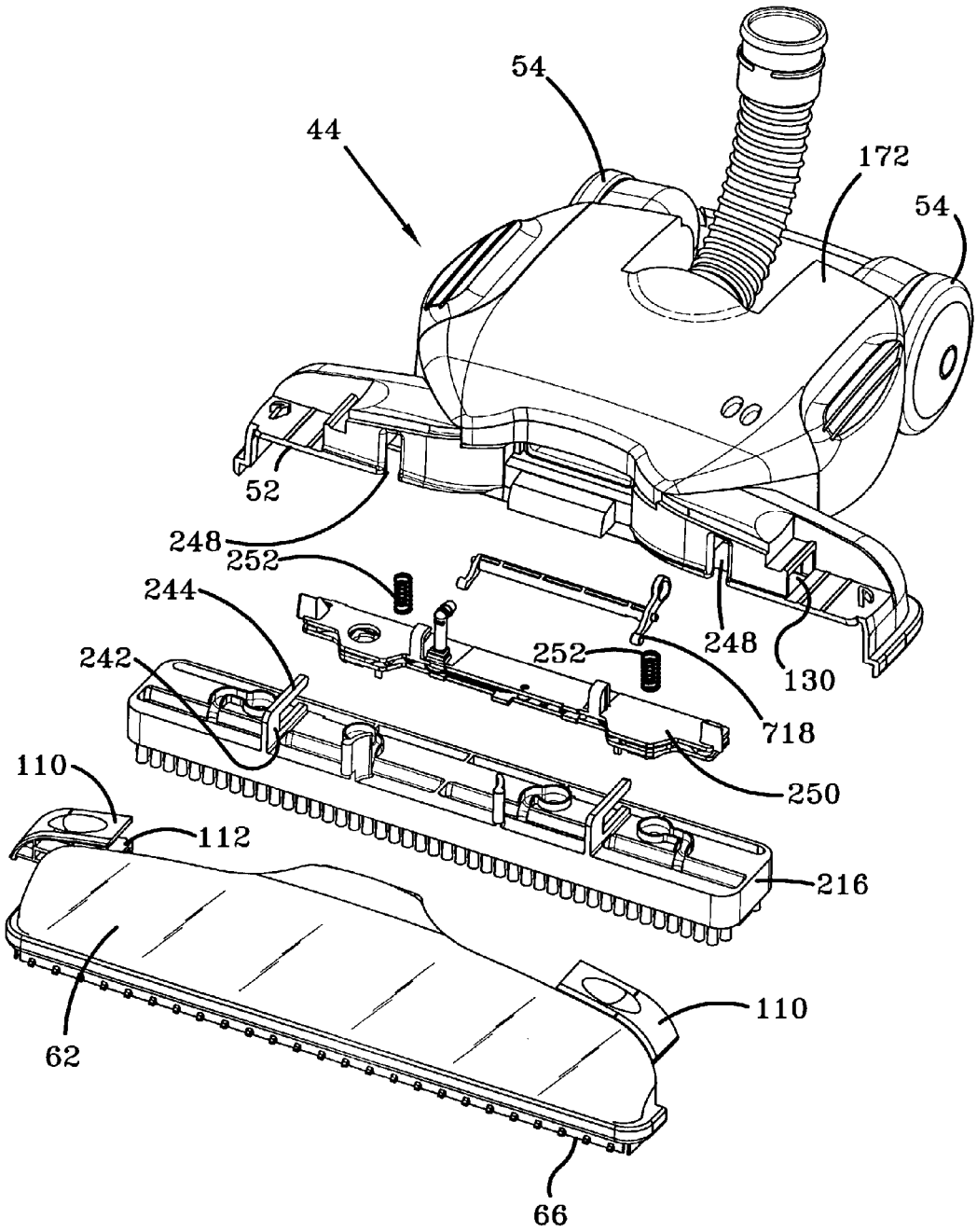
FIG. 2 is an exploded view of the of the base assembly of the floor cleaning unit of FIG. 1 illustrating the principle elements of the present invention.
Figure 3:
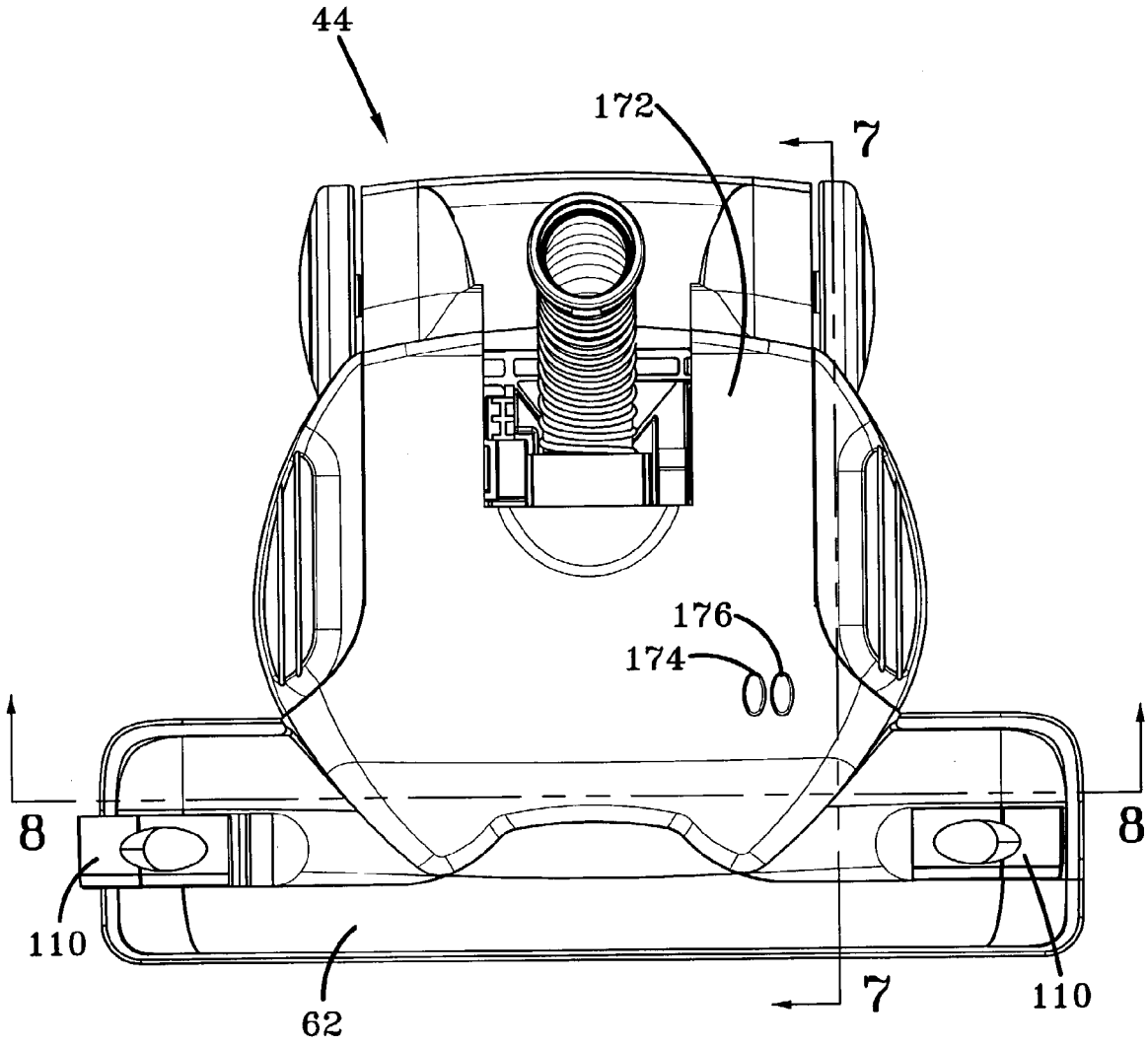
FIG. 3 is a top plan view of the base assembly of the floor cleaning unit of FIG. 1.

As depicted in FIG. 2, the nozzle assembly 62 includes an elastomeric squeegee 66 attached around its inlet. The nozzle assembly 62 includes a pair of slide latches 110 on opposite sides of the nozzle assembly 62 for removably securing the nozzle assembly 62 to the frame 52. When connecting the nozzle assembly 62 to the frame 52, each slide latch 110 is first slid outwardly. The nozzle assembly 62 is then positioned forwardly adjacent the brush assembly 216 and the latches 110 are slid inwardly so that the tongue member 112 extends partially through a lateral channel 130 formed in the frame 52 thereby locking the nozzle assembly to the frame 52. The brush block assembly 216 is removably secured to the base assembly 44 for agitating the surface to be cleaned.

Figure 5:
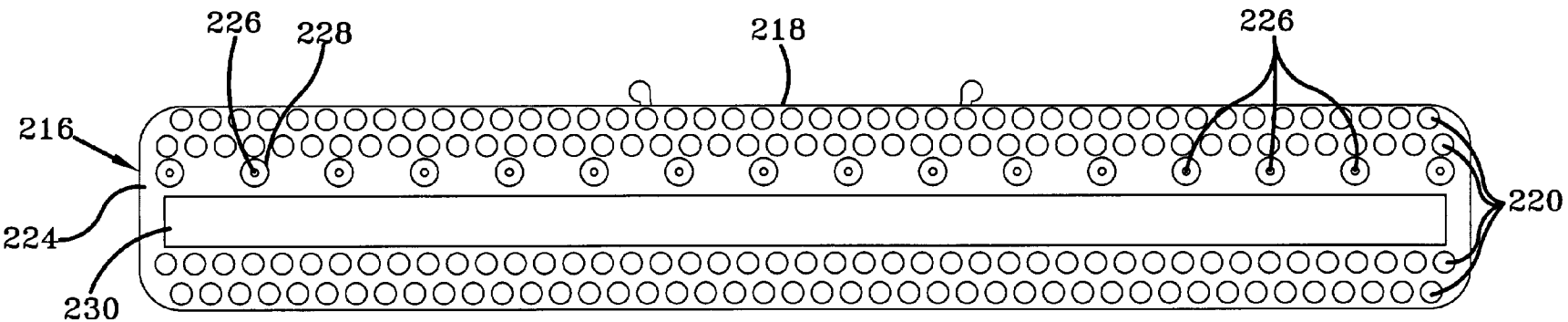
FIG. 5 is a bottom plan view of the brush block assembly of FIG. 4.
Figure 6:
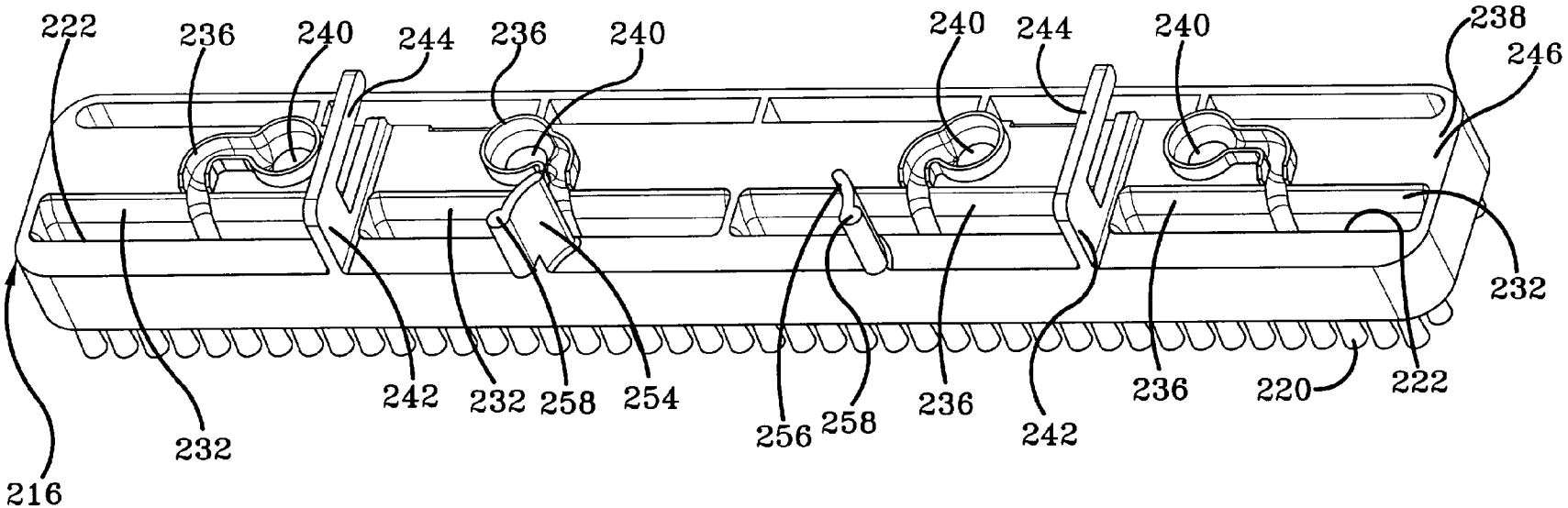
FIG. 6 is top and front perspective view of the brush block assembly of FIG. 4.
Figure 7:
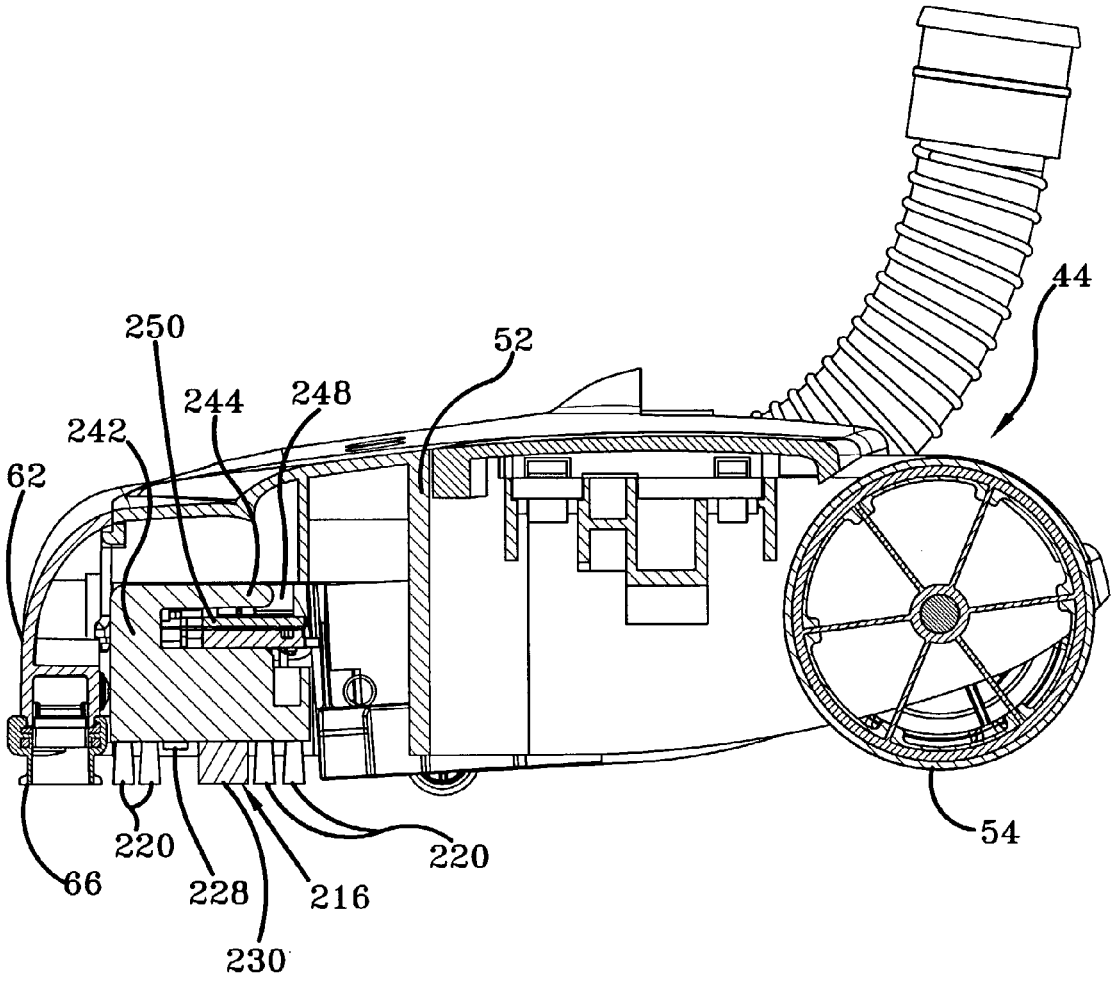
FIG. 7 is sectional view of taken along line 7—7 of FIG. 3.

In particular, as depicted in FIGS. 5 through 7, the brush block assembly 216 comprises a rectilinear brush support member 218 having two front and two rear rows of bristle bundles 220 compressively inserted into blind bores located in the support member 218. The rows are parallel to the longitudinal axis of the brush support member 218 and also oriented transversely to the cleaning path. The bristle bundles 220 project downwardly from the support member 218 for engagement with the cleaning surface.

Figure 4:
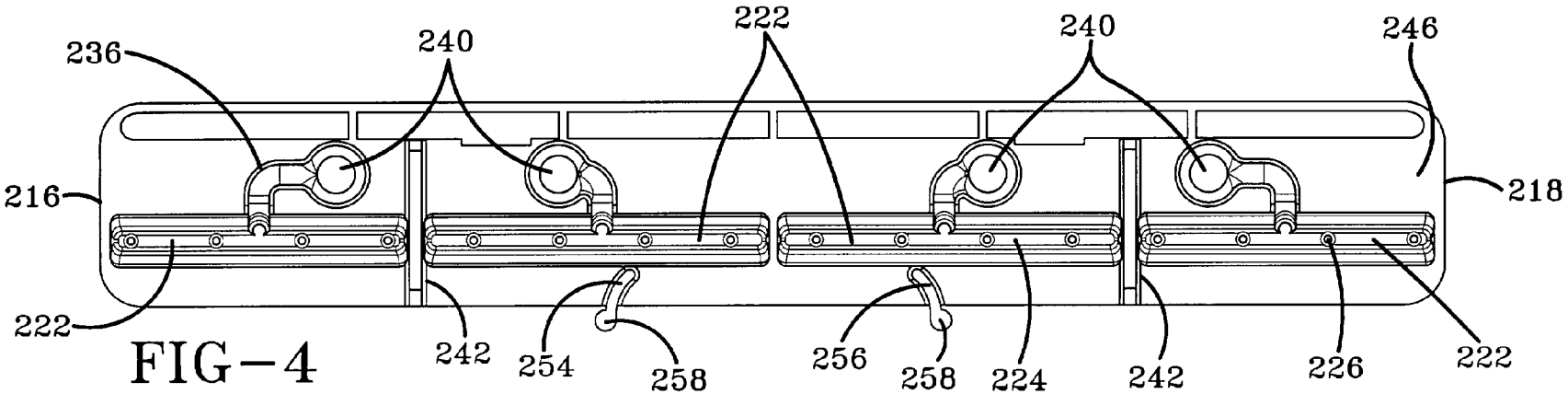
FIG. 4 is a top plan view of the brush block assembly of the floor cleaning unit of FIG. 1.

As best shown in FIG. 4, the support member 218 further includes a line of elongated slots 222 spaced longitudinally and disposed between the front and rear edges of the support member 218. A dispensing bar 224 is integrally formed with the bottom of the support member 218, underlying the bottom of slots 222. The dispensing bar 224 includes a row of openings 226 for the passage of cleaning solution from the solution tank 43. The openings 226 are aligned with the slots 222 for fluid communication therebetween. As shown in FIGS. 5 and 7, the outlets of the openings 226 define downwardly extending nipples 228 formed on the bottom of the dispensing bar 224 to direct the cleaning solution downward and prevent it from adhering and spreading on the bottom of the dispensing bar 224. An additional scrub strip 230 is adhesively mounted on the bottom of the support member forwardly adjacent the openings 226.

Together, the dispensing bar 224 and slots 222 define relatively deep compartments or troughs 232 (FIG. 6) in the support member 218, which break up bubbles of cleaning solution that collects therein. The relatively wide troughs 232 also allow easy rinsing and cleaning of dirt in collected therein. As best depicted in FIG. 6, recessed channels 240 are disposed in the upper surface 238 of the support member 218 to direct the cleaning solution to flow into the troughs 232. Integrally formed on the top surface 246 of the support member 218 are splash guards 236 that surround the channels 240 to prevent the cleaning solution from splashing out of the channels. Since the troughs 232 are spaced apart, the collecting of cleaning solution in one area is minimized in case of an error occurring in molding an uneven dispensing bar 224. A pair of outwardly curved ribs 254, 256, which define a handgrip, is attached on the top surface 246 of the support member near the front end. A nub 258 is formed at the forward end of each of the ribs 254, 256 for added grip support.

Figure 8:
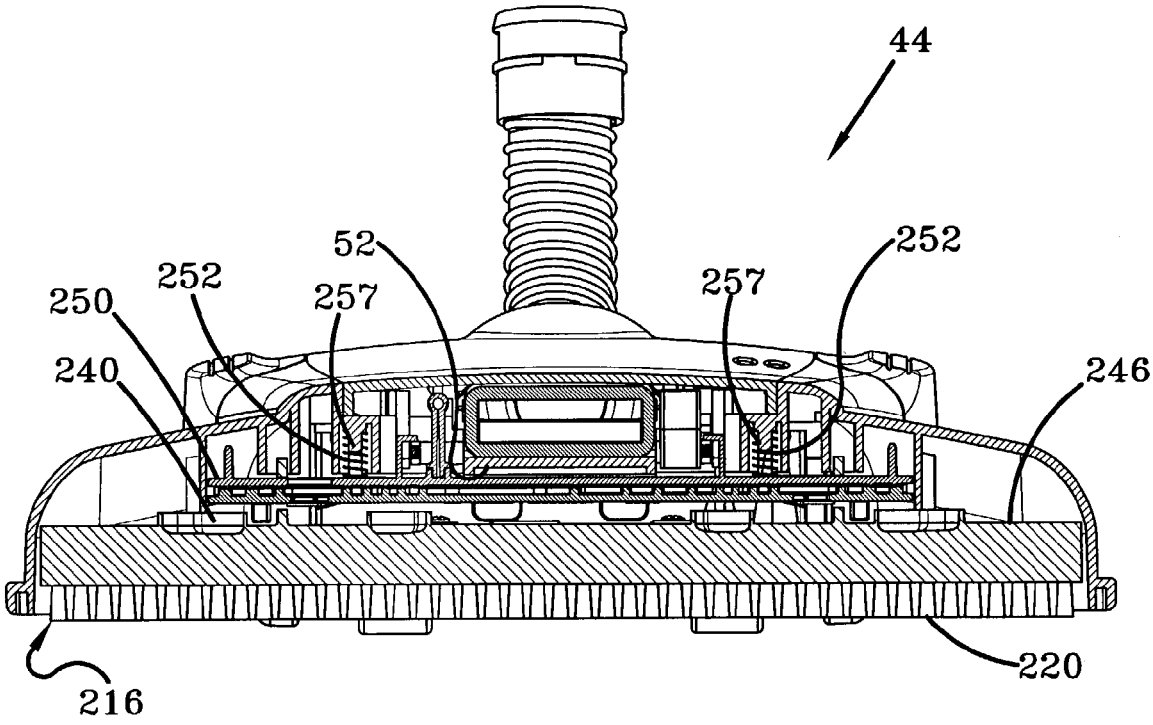
FIG. 8 is a sectional view taken along 8—8 of FIG. 3.
Figure 9:
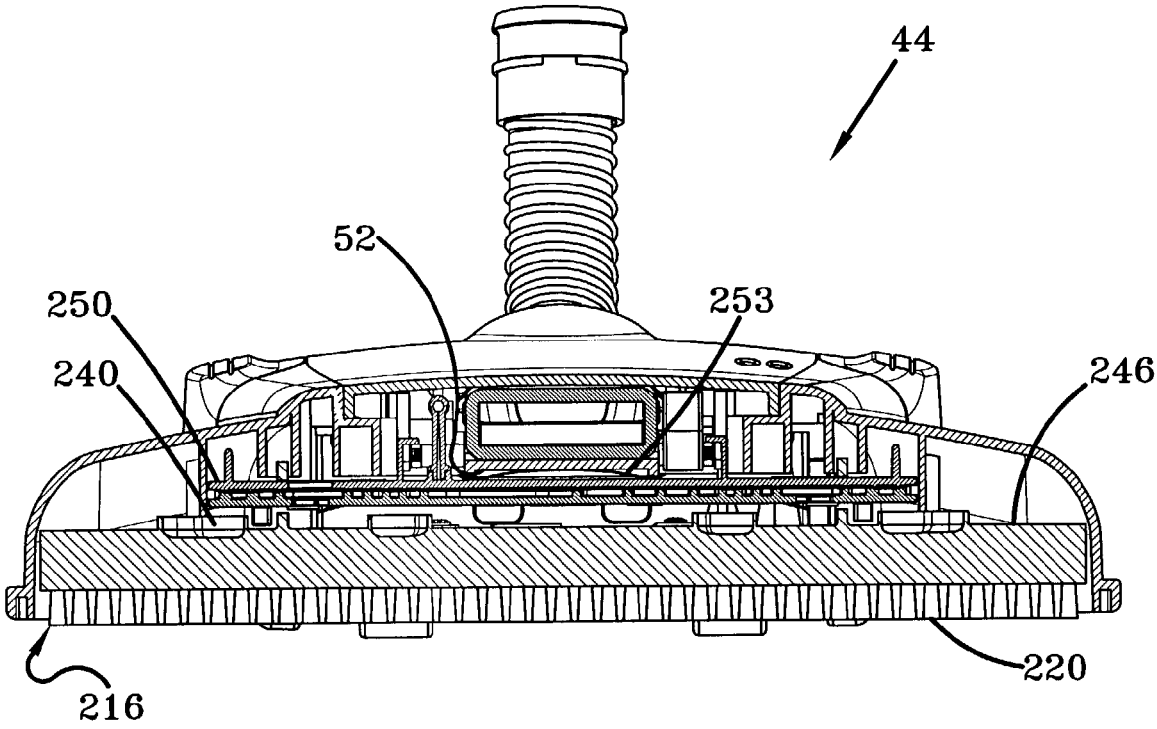
FIG. 9 is a view similar to FIG. 8 but showing another embodiment according to the present invention.

A pair of locating hooks 242 is attached to the top surface of the support member and extends rearwardly. As best depicted in FIG. 7, the lateral free leg 244 of each hook 242 is slidably received into a horizontal pocket or channel 248 formed in the frame 52 of the base assembly 44. The height of the pocket 248 is larger than that of the free leg 244 to allow room for the free leg 244 to move vertically and thereby allow the brush block assembly to float over irregular or uneven surfaces. With the brush block assembly so positioned, the nozzle assembly 62 abuts the front of the brush assembly 216 to secure the brush block assembly 216 to the frame 52, thereby preventing the brush assembly 216 from sliding out of the pockets 248. The hooks 242 also slidably engage upon the top of the distributor plate 250 at a position in which the outlets of the distributor plate 250 are aligned with the recessed channels 240, as shown in FIG. 8, to direct the cleaning solution to flow from the outlets of the distributor plate 250 into the trough 232. Two coil springs 252, inserted around their associated downwardly depending projections 257 of the frame 52, are positioned securely between the distributor plate 250 and frame to bias the brush block assembly 216 on the cleaning surface. Other suitable springs or biasing devices could be used such as, for example, a leaf spring 252 provided between the distributor plate 250 and frame 52 as depicted in FIG. 9.

To remove the brush block assembly 216 from the floor cleaning unit 40, a user slides the slide latches 110 of the nozzle assembly 62 outwardly and removes the nozzle assembly 62 to gain access to the brush block assembly 216. The user then grasps the ribs 254, 256 of the handgrip with his thumb and finger and pulls forward to slide the hooks out of the pockets 248 of the frame 52, thereby removing the brush block assembly 216 from the floor cleaning unit 40. Because of the removable feature of the brush block assembly 216, different types of brush assemblies can be interchangeably mounted to the frame 52, such as, for example, one having soft bristles to scrub wood surfaces. Further, the dispensing bar can also be a separate piece rather than being integrally formed with the support member 246.

Further details of the floor cleaning unit 40 are disclosed in co-pending patent application Ser. No. 09/956,297; the disclosure of which is incorporated by reference. The present invention has been described by way of example using the illustrated embodiment. Upon reviewing the detailed description and the appended drawings, various modifications and variations of the preferred embodiment will become apparent to one of ordinary skill in the art. All such obvious modifications and variations are intended to be included in the scope of the present invention and of the claims appended hereto.

In view of the above, it is intended that the present invention not be limited by the preceding disclosure of a preferred embodiment, but rather be limited only by the appended claims.

What is claimed is:

1. A floor cleaning unit having a base assembly for movement along a surface, said base assembly comprising:

a base part;

a brush assembly for engaging said cleaning surface, said brush assembly removably mounted to said base part;

a nozzle assembly removably mounted to said base part such that the nozzle assembly is positioned adjacent to the brush assembly to prevent the brush assembly from disengaging from the base part.

2. The floor cleaning unit of claim 1 wherein said brush assembly is slidably mounted to said base part.

3. The floor cleaning unit of claim 2 including an engaging member secured to said brush assembly, said base part having a channel formed therein for slidably receiving said engaging member.

4. The floor cleaning unit of claim 3 wherein said brush assembly has a support member, said engaging member includes a hook member attached to said support member and extending rearwardly.

5. The floor cleaning unit of claim 4 wherein said support member includes a plurality of rows of bristles extending downwardly, a dispensing bar provided on said support member, said dispensing bar including a row of fluid distribution openings parallel to said rows of bristles, said row of fluid distribution openings being positioned intermediate two said rows of bristles.

6. The floor cleaning unit of claim 5 wherein said support member includes at least one slot fluidly communicating with said distribution openings, said slot being structured and arranged to break up bubbles in fluid being distributed.

7. The floor cleaning unit of claim 6 wherein said dispensing bar is integrally formed with said support member.

8. The floor cleaning unit of claim 1 including a spring provided between said base part and said brush assembly, said spring being constructed and arranged to bias said brush assembly towards the cleaning surface.

9. A floor cleaning unit having a base assembly for movement along a surface, said base assembly comprising:

a base part;

a nozzle assembly mounted to said base part;

a brush assembly mounted to said base part, said brush assembly including a support member having a plurality of rows of bristles extending downwardly there from, said plurality of rows of bristles being formed from bristle bundles extending from blind bores in said support member;

a dispensing bar integrally formed with said support member, said dispensing bar including a row of fluid distribution openings parallel to said rows of bristles, said row of fluid distribution openings being positioned between two said rows of bristles, and directing fluid directly to the surface along which the base assembly moves.

10. The floor cleaning unit of claim 9 wherein said brush assembly is slidably mounted to said base part.

11. The floor cleaning unit of claim 9 wherein said support member includes at least one slot fluidly communicating with said distribution openings, said slot being structured and arranged to break up bubbles in fluid being distributed.

12. The floor cleaning unit of claim 11 wherein said support member includes a bottom portion, said dispensing bar being provided on said bottom portion.

13. The floor cleaning unit of claim 12 including a nipple disposed on said bottom portion of said dispensing bar under said distribution opening.

14. The floor cleaning unit of claim 11 wherein said support member includes a handgrip.

15. A floor cleaning unit having a base assembly for movement along a surface, said base assembly comprising:

a base part;

a nozzle assembly mounted to said base part;

a brush assembly mounted to said base part, said brush assembly including a support member having a plurality of rows of bristles extending downwardly;

a dispensing bar integrally formed with said support member, said dispensing bar including a row of fluid distribution openings parallel to said rows of bristles;

said row of fluid distribution openings being positioned between two said rows of bristles; and a spring provided between said base part and said brush assembly and positioned to bias said brush assembly towards said cleaning surface.

* * * * *